United States Patent [19]

Osberghaus et al.

[11] Patent Number: 4,648,882

[45] Date of Patent: Mar. 10, 1987

[54] POWDERY CARPET CLEANING PREPARATION CONTAINING ZEOLITE GRANULATE

[75] Inventors: Rainer Osberghaus, Duesseldorf; Franz Kresse, Hilden, both of Fed. Rep. of Germany

[73] Assignee: Henkel Kommanditgesellschaft auf Aktien, Duesseldorf, Fed. Rep. of Germany

[21] Appl. No.: 807,390

[22] Filed: Dec. 10, 1985

[30] Foreign Application Priority Data

Dec. 10, 1984 [DE] Fed. Rep. of Germany ..... 3444959

[51] Int. Cl.[4] ..... C11D 3/12; C11D 7/50; C11D 17/06; D06L 1/04

[52] U.S. Cl. ..... 8/142; 8/137; 23/313 R; 23/313 AS; 264/117; 252/88; 252/91; 252/140; 252/154; 252/163; 252/164; 252/167; 252/174; 252/174.17; 252/174.24; 252/174.25

[58] Field of Search ..... 252/88, 91, 140, 154, 252/174, 174.13, 174.24, 174.25, 174.17, 163, 164, 167; 264/117; 23/313 R, 313 AS; 8/137, 142

[56] References Cited

U.S. PATENT DOCUMENTS

| | | | |
|---|---|---|---|
| 3,418,243 | 12/1968 | Hoxie | 252/154 |
| 4,072,621 | 2/1978 | Rose | 252/140 |
| 4,096,081 | 6/1978 | Phenicie | 252/140 |
| 4,161,449 | 7/1979 | Smith | 252/8.6 |
| 4,171,277 | 10/1979 | Dankworth et al. | 252/99 |
| 4,244,834 | 1/1981 | Schwalley | 252/106 |
| 4,288,340 | 9/1981 | Dankworth et al. | 252/99 |
| 4,288,342 | 9/1981 | Wagner | 252/140 |
| 4,333,771 | 6/1982 | Altenschoepfer et al. | 134/7 |
| 4,379,080 | 4/1983 | Murphy | 252/526 |
| 4,395,347 | 7/1983 | McLaughlin | 252/139 |
| 4,414,130 | 11/1983 | Cheng | 252/140 |
| 4,493,781 | 1/1985 | Chapman et al. | 252/88 |
| 4,526,583 | 7/1985 | Gioffre | 8/137 |

FOREIGN PATENT DOCUMENTS

| | | |
|---|---|---|
| 1158405 | 12/1983 | Canada . |
| 2544605 | 4/1976 | Fed. Rep. of Germany . |
| 2806799 | 8/1979 | Fed. Rep. of Germany . |
| 3045221 | 6/1982 | Fed. Rep. of Germany . |
| 461685 | 10/1968 | Switzerland . |

*Primary Examiner*—Dennis L. Albrecht

*Attorney, Agent, or Firm*—Ernest G. Szoke; Henry E. Millson, Jr.; Real J. Grandmaison

[57] ABSTRACT

A carpet cleaning preparation in the form of a dry cleaning preparation in powder form which contains surfactants, organic solvents and zeolite and which is characterized in that the zeolite is in the form of a porous granulate which is unaffected by the mechanical stresses normally encountered during dry cleaning. The zeolite is preferably in the form of a porous granulate containing less than 2% by weight of particles 0.05 mm and smaller in size and less than 5% by weight of particles larger than 2 mm in size.

18 Claims, No Drawings

POWDERY CARPET CLEANING PREPARATION CONTAINING ZEOLITE GRANULATE

BACKGROUND OF THE INVENTION

1. Field of the Invention

This invention relates to a powder-form, zeolite-containing preparation intended for the dry cleaning of fabrics, particularly carpets.

2. Statement of the Related Art

In addition to shampoos, powder-form cleaning preparations have recently been used to an increasing extent for cleaning carpets and other textile coverings in situ, having the advantage of not leaving any ridges and drying more quickly. Cleaning powders of the type in question contain as their principal constituents surfactants and adsorbents and also relatively large quantities of water in loosely bound form. It is assumed that the surfactants, together with the water present, are responsible for detaching the dirt particles from the fibers and transporting them to the adsorbent which, after evaporation of the water, is removed together with the soil by brushing or vacuum cleaning. Various materials have been proposed as adsorbents, including for example powdered synthetic resin foam (AT No. 296 477), fuller's earth, talcum, sawdust (U.S. Pat. No. 3,418,243) and bleached wood powder (CH-PS No. 461 685).

In spite of the much smaller quantities of liquid which are applied with these powder-form preparations compared with shampoos, drying times of up to several hours are still necessary because otherwise the residues cannot be completely removed. This is a disadvantage, above all in the case of industrial cleaning.

An adsorbent which has proved to be particularly effective both in shampoos and also in cleaning powders is a sodium aluminosilicate known as zeolite. Zeolite-based preparations, of the type described for example in DE-OS No. 25 44 605, are distinguished by their high cleaning power. However, they also involve problems arising out of the emission of dust and the unusually strong adhesion of the finely divided zeolite powder to the textile fibers, as a result of which the cleaning preparation cannot be completely removed, leaving the treated fabrics, particularly dark-colored carpets, discolored in appearance. These undesirable side effects have not really been eliminated by the proposal in U.S. Pat. No. 4,493,781 to add zeolite powder onto an equally insoluble carrier, particularly cellulose powder. Accordingly, there is still a need to develop dry cleaning preparations for fabrics having better overall properties.

OBJECT OF THE INVENTION

An object of the present invention is the development of dry cleaning preparations in powder form for cleaning carpets and fabrics which preparations contain surfactants, organic solvents and zeolite and are characterized in that the zeolite is in the form of a porous granulate which is unaffected by the mechanical stresses normally encountered during dry cleaning.

A further object of the present invention is the development of an improvement in dry cleaning preparations in powder form for cleaning carpets and fabrics containing surfactants, organic solvents and zeolites, the improvement consisting of said zeolites being in the form of a porous granulate comprised of said zeolites and at least one granulating aid, which granulate is unaffected by the mechanical stresses normally encountered during dry cleaning.

These and other objects of the invention will become more apparent as the description of the invention continues.

DESCRIPTION OF THE INVENTION

The present invention provides cleaning preparations in powder form for cleaning carpets and other textiles which contain surfactants, organic solvents and zeolite and which are characterized in that the zeolite is in the form of a porous granulate which is unaffected by the mechanical stresses normally encountered during dry cleaning.

The preparations according to the invention do not have any of the above-mentioned disadvantages of state-of-the-art preparations, i.e. they do not give off any troublesome dust in use and may be almost completely removed from the fabrics, so that no discoloration occurs. The resoiling of the fabrics after cleaning is negligible. The preparations according to the invention are further distinguished by the fact that, in their practical application, there is normally no need for any drying time between application of the powder to the fabric and removal of the powder. One particularly surprising aspect of the solution provided by the invention is the discovery that, despite the agglomeration of the zeolite powder to relatively large stable particles, the present preparation has equally high cleaning power as the preparations containing finely divided zeolite.

The production of the preparations according to the invention comprises two stages, namely production of the zeolite granulate which, in its most simple form, consists of zeolite and granulating aid and mixing the granulate with the other constituents of the preparation. However, some of these constituents may even be completely or partly incorporated in the granulates in the first stage, so that only the remaining constituents, particularly the organic solvents need be mixed with the porous granulates, the liquid constituents in particular being taken up by the porous granulates.

Starting materials for producing the granulates are the finely divided crystalline zeolites of types A, P, X, Y and hydroxysodalite which may be used either in dry form or in the form of the aqueous suspensions accumulating during their production. The exchangeable cations present in the zeolites should be predominantly sodium ions. It is preferred to use zeolite A which has a particularly high cleaning power and is readily available. In its standard commercial air-dried form, it has a water content of from about 15 to 25% by weight which cannot be further reduced without applying extreme conditions. Accordingly, the quantities of zeolite quoted in parts by weight include the water content of the zeolites which cannot be removed by drying in air, unless otherwise indicated.

In their final form, the cleaning preparations according to the invention have a zeolite content of from 40 to 90% by weight and preferably from 55 to 75% by weight.

Zeolite granulates are known in various compositions from the literature, but are generally not suitable in that form for the dry cleaning of fabrics. Thus, DOS No. 28 06 799 describes zeolite granulates which are produced by calcination at temperatures around 800° C. and which are used for softening drinking water. Other types of zeolite granulates are known, for example, from U.S. Pat. Nos. 4,171,277, 4,288,340 and 4,333,771, from DE-OS No. 30 45 221, and from CA-PS No. 1,158,405. The granulates described therein are primarily intended for use in detergents, i.e. their composition is optimized for rapid disintegration of the granulates in the washing water, granulation being carried out in every case by the build-up process, i.e. by agglomeration of the finely divided zeolite using various additives.

The zeolite granulates suitable for the cleaning preparations according to the invention may also be obtained by build-up granulation, for example by agglomeration of zeolite powder using water and a granulating aid in a drum or paddle mixer or on a pan granulator. Other constituents of the cleaning preparations, such as surfactants or acids, may be incorporated in the granulates. Where water is used during granulation or where moist starting materials are used, the granulation process is followed by a drying step which may also be carried out in known manner, for example in a fluidized bed at temperatures of up to about 200° C.

A particularly preferred process for the production of suitable, porous zeolite granulates is the spray-drying process, in which an aqueous suspension of the zeolite, the granulating aid, and, optionally, other constituents is sprayed into droplets which then dry on falling downwards in a stream of air. On the one hand, this process makes it possible to process aqueous starting materials without any problems and, on the other hand, combines the formation of the granulate particles and their drying in a single process.

At all events, the desired effect of the granulation process is that distinctly larger particles are built up from the originally very finely divided zeolite, showing such mechanical stability that they withstand the brushing and rubbing which they encounter in practical application without material disintegration in size. Suitable granulates contain less than 2% by weight of particles 0.05 mm in size and smaller and less than 5% by weight of particles larger than 2 mm (as determined by sieve analysis). The best in-use properties are shown by granulates of which more than 80% by weight and preferably more than 90% by weight of the individual particles have diameters of larger than 0.2 mm up to 1.6 mm. The mechanical stability of the granulates may be determined by a simple test: in a 1-liter-capacity vibrating ball mill of porcelain filled with 5 porcelain balls 28 mm in diameter, 100 g of the granulate are treated for 1 minute at 1400 r.p.m. and then sieved. Under these test conditions, the proportion of particles up to 0.2 mm in size in granulates suitable for use in accordance with the invention increases by no more than 15% by weight, preferably by no more than 5% by weight and more preferably by no more than 2% by weight, based on the total weight of the granulate.

Preferably therefore the porous zeolite granulates however produced should contain less than 2% by weight of particles 0.05 mm in size and smaller and less than 5% by weight of particles larger than 2 mm as determined by sieve analysis and have a mechanical stability when subjected to a a vibrating ball mill filled with about 5 porcelain balls 28 mm in diameter for 1 minute at 1400 rpm and then sieved, such that the proportion of particles up to 0.2 mm in size increases to no more than 15% by weight, based on the total weight of the granulate.

Suitable granulating aids are solid, readily water-soluble organic or inorganic substances which have only a slight tendency towards crystallization and which are not hygroscopic. Particularly suitable granulating aids are substances which have a tendency towards polymerization, such as water-soluble alkali metal silicates, or which already have a polymeric structure, such as polymeric carboxylic acids and salts therof and also soluble cellulose derivatives. It is preferred to use water-soluble homopolymers and copolymers of acrylic or methacrylic acid. A particularly preferred granulating aid is soluble sodium silicate in conjunction with polyacrylic acid or polymethacrylic acid. The granulating aid is used in a quantity of from 1 to 20% by weight and preferably in a quantity of from 5 to 20% by weight, based on the cleaning preparation as a whole. Based on the anhydrous zeolite content, the granulating aid is used in a quantity of from 3 to 40% by weight and preferably in a quantity of from 10 to 30% by weight.

Suitable surfactants for the cleaning preparations according to the invention are primarily nonionic and anionic surface-active compounds. Nonionic surfactants are preferably used.

Particularly suitable anionic surfactants are those of the sulfate and sulfonate type, although other types, such as soaps, long-chain N-acyl sarcosinates, salts of fatty acid cyanamides or salts of ether carboxylic acids, of the type obtainable from long-chain alkyl or alkylphenyl poly-ethylene glycol ethers and chloroacetic acid, may also be used. The anionic surfactants are normally used in the form of the sodium salts.

Particularly suitable surfactants of the sulfate type are the sulfuric acid monoesters of long-chain primary alcohols of natural and synthetic origin containing from 10 to 20 carbon atoms, i.e. of fatty alcohols such as, for example, coconut oil fatty alcohols, tallow fatty alcohols, oleyl alcohol, or of $C_{10}$–$C_{20}$ oxoalcohols and those of secondary alcohols having chain lengths in the same range. Other suitable surfactants of the sulfate type are sulfuric acid monoesters of aliphatic primary alcohols, secondary alcohols or alkylphenols ethoxylated with from 1 to 6 mols of ethylene oxide. Sulfated fatty acid alkanolamides and sulfated fatty acid monoglycerides are also suitable.

The surfactants of the sulfonate type suitable for use in accordance with the invention are primarily the salts of sulfosuccinic acid monoesters and diesters containing from 6 to 22 carbon atoms in the alcohol portions, alkylbenzene sulfonates containing $C_9$–$C_{15}$ alkyl groups and lower alkyl esters of $\alpha$-sulfofatty acids, for example the $\alpha$-sulfonated methyl or ethylesters of hydrogenated coconut oil fatty acids, hydrogenated palm kernel oil fatty acids or hydrogenated tallow fatty acids. Other suitable surfactants of the sulfonate type are the alkane sulfonates obtainable from $C_{12}$–$C_{18}$ alkanes by sulfochlorination or sulfoxidation and subsequent hydrolysis or neutralization or by addition of bisulfites onto $C_{12}$–$C_{18}$ olefins and also the olefin sulfonates i.e. mixtures of alkene and hydroxyalkane sulfonates and disulfonates, obtained for example from long-chain monoolefins containing a terminal or internal double bond by sulfonation with gaseous sulfur trioxide and subsequent alkaline or acidic hydrolysis of the sulfonation products.

Suitable nonionic surfactants for the cleaning preparations according to the invention are in particular adducts of from 1 to 30 mols and preferably from 4 to 15 mols of ethylene oxide onto 1 mol of a compound containing from 10 to 20 carbon atoms from the group comprising alkanols, alkylphenols, alkane carboxylic acids and alkane carboxylic acid amides. Of particular importance are the adducts of ethylene oxide onto long-chain primary or secondary alcohols, such as for example fatty alcohols or oxoalcohols, and with mono- or dialkylphenols containg from 6 to 14 carbon atoms in the alkyl groups.

Other suitable nonionic surfactants are the water-soluble adducts containing from 20 to 250 ethylene glycolether groups and from 10 to 100 propylene glycolether groups produced by addition of ethylene oxide onto polypropylene glycol, alkylene diamine polypropylene glycol or alkylpolypropylene glycols containing from 1 to 10 carbon atoms in the alkyl chain, in which the polypropylene glycol chain functions as a hydrophobic residue. It is also possible to use nonionic surfactants of the amine oxide, sulfoxide or alkylglucoside type, for example N-cocosalkyl-N, N-dimethylamine oxide or the condensates of long-chain $C_{10}$–$C_{18}$ alcohols and glucose, as well as the ethylene oxide adducts thereof.

Particularly preferred nonionic surfactants are the reaction products of from 4 to 15 mols of ethylene oxide (EO) and 1 mol of fatty alcohol containing from 12 to 18 carbon atoms. Typical representatives of these surfactants are tallow fatty alcohol+5 EO, tallow fatty alcohol+14 EO, oleyl/cetyl alcohol+10 EO and coconut oil fatty alcohol+4 EO.

The surfactants are present in the cleaning preparations according to the invention in a quantity of from 0.5 to 15% by weight and preferably in a quantity of from 1 to 5% by weight. They are preferably incorporated completely or partly in the first step of the production process, i.e. during granulation of the zeolite.

The cleaning preparations according to the invention contain organic solvents as further components. Suitable organic solvents are any of the components normally used for cleaning fabrics, although is is preferred to use solvents having boiling points above 80° C. selected from the group comprising benzines, alcohols, ethers and esters. Examples of solvents such as these are benzine (boiling range 140° to 200° C.), isopropanol, isooctanol, triethylene glycol, butyldiglycol (butoxyethoxyethanol) and butyldiglycolacetate. Benzine, isopropanol, dipropylene glycolmonomethylether and mixtures thereof are particularly preferred by virtue of their high fat-dissolving power. The solvent content of the cleaning preparation is from 5 to 30% by weight and preferably from 8 to 25% by weight. Water is only present in the cleaning preparation in that quantity which is retained by the zeolites during production of the granulate.

From their production, synthetic zeolites often contain relatively large quantities of free alkalis, as reflected in the high pH values of aqueous suspensions. Since many textiles and dyes are sensitive to alkalis, acids may be added during production of the cleaning preparations to neutralize the alkali and thus to avoid damage. Solid, water-soluble organic or inorganic acids, for example amidosulfonic acid and oxalic acid, are preferred. Acidic alkali metal phosphates, tartaric acid, citric acid and ethylene diamine tetraacetic acid are particularly preferred, because their salts which are formed during neutralization support the cleaning effect of the preparations. The quantity of acid is determined by the alkali content of the zeolite and by the desired degree of neutralization. The acid is generally used in a quantity of no more than 10% by weight, based on the preparation as a whole, and preferably in a quantity sufficient to provide the zeolite granulate with a pH-value of from 6.5 to 9 (as measured on a 1% suspension in water.)

Polymeric carboxylic acids, such as polyacrylic acid and polymethacrylic acid, are also suitable for neutralization. Where acids such as these have already been used as granulating aids, the addition of other acids is not normally necessary.

In addition to the constituents already mentioned, the cleaning preparations according to the invention may contain other constituents of the type normally used in the cleaning of textiles, such as for example antistatic agents, optical brighteners, resoiling inhibitors and perfume. These constituents together may be present in quantities of from 0 up to 10% by weight and preferably in quantities of from 0 to 5% by weight, based on the cleaning preparation as a whole. They are preferably added to the zeolite granulate with the solvent in the second stage of the production process.

The cleaning of textiles and carpets is normally carried out by applying the preparations according to the invention to the surfaces to be cleaned and then rubbing them intensively into the textiles for example using a sponge or a brush, the soil on the textiles being adsorbed onto the particles of the cleaning preparation. The rubbing-in times are generally from 0.5 to 2.5 minutes and preferably from 0.5 to 1.5 minutes per square meter. The residues are then mechanically removed from the textiles together with the soil, for example by brushing or vacuum cleaning. For the surface cleaning of textiles, the preparations according to the invention are applied in quantities of from 20 to 200 grams per square meter, depending on the fullness of the textiles and the degree of soiling, although they may even be locally applied in larger quantities for removing individual stains. For cleaning carpets, the preparations according to the invention are normally applied in quantities of from 50 to 150 grams per square meter. Although all the steps of the process may be carried out manually, the preferred embodiment, particularly in the case of carpets, is characterized in that rubbing in and, optionally, other steps are carried out by machines, for example by combined scattering and brushing machines. Accordingly, the cleaning process is suitable both for domestic application and also for industrial application.

The following examples are illustrative of the invention without being limitative.

EXAMPLES

Examples 1 to 4, Cleaning Preparations

Example 1

In a drum mixer designed for laboratory use, 1.12 kg of zeolite A (sodium form, water content 18.2%, as determined by drying at 800° C.) in powder form (particle size below 40 μm) and 124 g of powder-form polymethacrylic acid (Rohagit S, a product of the Rohm firm) were continuously mixed and sprayed with a solution of 38 g of waterglass (25% in $H_2O$, $SiO_2$:-$Na_2O$=4:1) and 14 g of a nonionic surfactant of tallow alcohol adducted with 14 mols EO in 700 ml of tapwater. After the addition, mixing was continued for 10 minutes, after which the free-flowing granulate formed was discharged. In order to remove excess adhering water, the granulate was placed in a pan and dried to constant weight in a drying cabinet at 80° C. A 1% suspension of this granulate in water had a pH value of 8.5. Sieve analysis of the granulate showed that 95% thereof had a particle size of from 0.3 to 1.2 mm. In the stability test, the percentage of fines (up to 0.2 mm) rose from 1.2% to 4.1%.

To produce the cleaning preparation, 750 g of the dried granulate were impregnated while stirring with a solution of 20 g of a nonionic surfactant of tallow alcohol adducted with 14 mols EO in 100 g of isopropanol and 130 g of butyldiglycol (butoxyethoxyethanol). The cleaning powder formed flowed freely and was free from dust.

Example 2

In a Lodige mixer, 8.6 kg of zeolite A and 1 kg of powdered polymethacrylic acid, both of the same quality as in Example 1, as well as 0.4 kg of polyvinyl pyrrolidone (Kollidon C1, a product of BASF), which was used to enhance cleaning, were continuously mixed and sprayed with a solution of 0.3 kg of waterglass (25% in $H_2O$, $SiO_2$:$Na_2O$=4:1) and 0.15 kg of a nonionic surfactant of tallow alcohol adducted with 14 mols of ethylene oxide in 5.7 kg of water. After the addition, a water-containing granulate was obtained, which was dried for 5 minutes by heating the mixer to 110° C. with continuing mixing. Sieve analysis showed that 91% of the granulate had a particle size of from 0.5 to 1.5 mm. The fines (particles smaller than 0.2 mm) amounted to 0.6%, increasing to 3.8% in the stability test. A 1% suspension of the granulate in water had a pH value of 8.9.

The granulate was further processed in an open mixing vessel in which it was converted into the end product by the addition with slow stirring of 25% by weight of isopropanol (based on the final mixture).

Example 3

A mixture of 270 kg of a 45% aqueous suspension of zeolite Na-A (content based on anhydrous zeolite), 46 kg of waterglass (37°/40° Be, 34.5% aqueous solution) 18.8 kg of polymethacrylic acid, 4.0 kg of tallow alcohol adducted with 5 mols EO and 3.5 kg of tallow alcohol adducted with 14 mols EO was homogenized, heated to 65° C. and sprayed into the upper end of a spraying tower. Drying took place in countercurrent with air having an entry temperature of from 150° C. to 180° C. Of the granulate obtained in this way, 98.2% consisted according to sieve analysis of particles from 0.2 to 1.6 mm in size, 0.2% of fines (smaller than 0.05 mm) and 0.5% of particles larger than 2 mm. In the stability test, the percentage of fines (particles up to 0.2 mm in size) increased from 0.6% to 1.4%.

To produce the cleaning preparation, 170 kg of the dry granulate were mixed in a mixing vessel with 30 kg of benzine (Isopar G). A white, free-flowing product with a dry feel was obtained.

Example 4

This cleaning preparation was prepared from the same zeolite granulate as the cleaning preparation of Example 3. In this case, however, 20 kg of a mixture of 50% by weight of benzine (Isopar G, boiling point 165° C.) and 50% by weight of n-propanol were added to quantities of 80 kg of the granulate.

Comparison Examples 5 and 6, Conventional Cleaning Preparations

Example 5

A powder-form carpet cleaner of zeolite powder charged with coconut oil fatty acid diethanolamide was produced in accordance with DOS No. 25 44 605, Example 21, by mixing with a solution of coconut oil fatty alcohol sulfate and isopropanol. The product consisted predominantly of very fine powder particles smaller than 0.05 mm in size. In addition, loose agglomerates up to 5 mm in size were present after mixing. In the stability test, the product disintegrated completely into particles smaller than 0.2 mm in diameter.

Example 6

A powder-form carpet cleaner of cellulose fibers, zeolite powder, calcium carbonate, propylene glycol methylether and water was prepared in accordance with U.S. Pat. No. 4,493,781, Example 1. The product obtained was flaky and slightly tacky and contained no hard granulates at all, so that it did not fulfill the stability test.

Example 7

Cleaning Effect, Dust Emission and Resoiling

The performance properties of the cleaning preparations were tested on naturally soiled, beige-colored polyamide velvet-pile carpets. To this end, a long strip of carpet was divided into several segments which were each uniformly scattered with one of the cleaning preparations of Examples 1 to 6 in quantities of 70 g per square meter. Immediately after application, the cleaning preparations were worked into the carpet for about 45 secs. per square meter using an industrial, 40 kg single-disc rotary cleaning machine. Only the preparation according to U.S. Pat. No. 4,493,781 was also subjected to a test without brushing in, as described in Example 1. After the time sufficient for drying, the carpet segments were vacuum-cleaned for about 1 minute per square meter to remove both the cleaning preparations and also the adhering soil as far as possible. After the cleaning result had been evaluated, the strip of carpet was released for use and the degree of resoiling assessed for 3 weeks.

The performance properties were evaluated by five examiners who awarded marks of from 1 (excellent) to 6 (very poor). The average values of the individual marks are shown in Table 1.

Example 8

Discoloration

To determine discoloration, dark-red polyamide velvet-pile carpets which were not soiled were treated with the cleaning preparations as in Example 7. Discoloration was then visually determined by comparison with untreated pieces of carpet and evaluated on a points scale (1=no discoloration, 5=very serious discoloration). The results are shown in the last column of Table 1.

TABLE 1

| Cleaning preparation according to | Evaluation of performance properties | | | | |
|---|---|---|---|---|---|
| | Necessary drying time (mins.) | Dust emission | Cleaning power | Re-soiling | Dis-color-ation |
| Example No. | | | | | |
| 1 | 0 | 1.2 | 1.8 | 3.2 | 1 |
| 2 | 0 | 1.4 | 1.6 | 2.8 | 1 |
| 3 | 0 | 1.0 | 1.4 | 2.2 | 1 |
| 4 | 0 | 1.0 | 1.8 | 2.4 | 1 |
| Comparison Examples | | | | | |
| 5 | 0 | 3.2 | 1.8 | 5.0 | 2–3 |
| 6 | 30 | 4.8 | 2.4 | 4.6 | 2–3 |
| 6* | 15 | 1.6 | 4.6 | 3.8 | 2 |

*without brushng in

The preceding sepcific embodiments are illustrative of the invention. It is to be understood however, that other expedients known to those skilled in the art or disclosed herein may be followed without departing from the spirit of the invention or the scope of the appended claims.

What is claimed is:

1. A dry cleaning preparation in powder form for cleaning carpets and fabric which preparation consists essentially of (a) from 40 to 90% by weight of zeolite, (b) from 0.5 to 15% by weight of at least one surfactant, (c) from 5 to 30% by weight of at least one organic dry cleaning solvent, (d) from 1 to 20% by weight of at least one granulating aid, (e) from 0 to 10% by weight of at least one solid, water-soluble acid, and (f) from 0 to 10% by weight of other customary constituents of dry cleaning preparations in powder form, wherein at least components (a), (d), and (e) are combined to form a porous zeolite granulate which withstands the mechanical stressing normally encountered in dry cleaning and containsless than 2% by weight of particles 0.05 mm in size and smaller and less than 5% by weight of particles larger than 2 mm as determined by sieve analysis and have a mechanical stability when subjected to a vibrating ball mill filled with about 5 porcelain balls 28 mm in diameter for 1 minute at 1400 rpm and then sieved, such that the proportion of particles up to 0.2 mm in size increases to no more than 15% by weight, based on the total weight of the granulate, and wherein this granulate is then united with components (c), (f) and the remaining parts of (b).

2. The dry cleaning preparation of claim 1 wherein, before or during production of said porous granulate, the zeolite is adjusted with an acid to pH-value of from 6.5 to 9 (as measured on 1% suspension of the granulate in water).

3. The dry cleaning preparation of claim 1 wherein said at least one surfactant is selected from the group consisting of adducts of from 1 to 30 mols of ethylene oxide with long-chain primary or secondary alcohols containing from 10 to 20 carbon atoms or with alkylphenols containing from 6 to 14 carbon atoms in the alkyl groups and mixtures thereof.

4. The dry cleaning preparation of claim 1 wherein said at least one organic dry cleaning solvent has a boiling point above 80° C. and is selected from the group consisting of benzines, alcohols, ethers, esters and mixtures thereof.

5. The dry cleaning preparation of claim 1 wherein said at least one granulating aid is selected from the group consisting of water-soluble alkali metal silicates, water-soluble polymeric carboxylic acids and salts thereof, water-soluble cellulose derivatives and mixtures thereof.

6. The dry cleaning preparation of claim 1 consisting essentially of from 55 to 75% by weight of zeolite Na-A, from 1 to 5% by weight of an adduct of from 4 to 15 mols of EO onto $C_{12}$–$C_{18}$ fatty alcohols, from 8 to 25% by weight of an organic solvent selected from the group consisting of dipropylene glycol monomethylether, benzine, isopropanol and mixtures thereof, from 5 to 20% by weight of a granulating aid in the form of a combination of water-soluble sodium silicate and polyacrylic acid or polymethacrylic acid and from 0 to 5% by weight of other usual constituents for dry cleaning preparation in powdered form.

7. A process for cleaning carpets and textiles, characterized in that the dry cleaning preparation of claim 1 is applied to the textile in quantities of from 20 to 200 grams per square meter and is intensively rubbed into the textile for 0.5 to 2.5 minutes per square meter, the soil and cleaning preparation combining with one another, after which the residues are mechanically removed from the textile.

8. A process for cleaning carpets as claimed in claim 7 characterized in that the rubbing-in of the cleaning preparation and, optionally, other steps of the process are carried out by means of appliances or machines, from 50 to 150 grams per square meter of cleaning preparation are used and the rubbing-in time is from 0.5 to 1.5 minutes per square meter.

9. In a dry cleaning preparation in powder form for cleaning carpets and textiles containing 0.5 to 15% by weight of surfactants, 5 to 30% by weight of organic solvents and 40 to 90% by weight of zeolites, the improvement comprising said zeolites being in the form of a porous granulate comprised of said zeolites and at least 1 to 20% by weight of one granulating aid, wherein said granulate is unaffected by the mechanical stresses normally encountered during dry cleaning and contains less than 2% by weight of particles 0.05 mm in size and smaller and less than 5% by weight of particles larger than 2 mm as determined by sieve analysis and have a mechanical stability when subjected to a vibrating ball mill filled with about 5 porcelain balls 28 mm in diameter for 1 minute at 1400 rpm and then sieved, such that the proportion of particles up to 0.2 mm in size increases to no more than 15% by weight, based on the total weight of the granulate.

10. A dry cleaning preparation in powder form for cleaning carpets and textiles wherein said preparation comprises;

(a) from 40 to 90% by weight of zeolite, (b) from 1 to 20% by weight of a granulating aid for said zeolite;

(c) from 0.5 to 15% by weight of a surfactant;

(d) from 5 to 30% by weight of an organic solvent, and (e) up to 10% by weight of a solid, water-soluble acid, all weights being based on the weight of said preparation, wherein at least components (a), (b), and (e) are combined to form a porous zeolite granulate which withstands the mechanical stressing normally encountered in dry cleaning and contains less than 2% by weight of partciles 0.05 mm in size and smaller and less than 5% by weight of particles larger than 2 mm as determined by sieve analysis and have a mechanical stability when subjected to a vibrating ball mill filled with about 5 porcelain balls 28 mm in diameter for 1 minute at 1400 rpm and then sieved, such that the proportion of particles up to 0.2 mm in size increases to no more than 15% by weight, based on the total weight of the granulate, and wherein this granulate is then united with components (c), and (d).

11. The dry cleaning preparation of claim 10 wherein said zeolite is of type A containing sodium ions as exchangeable cations.

12. The dry cleaning preparation of claim 10 wherein more than 80% by weight of said porous zeolite granulate consists of particles larger than 0.2 to 1.6 mm in size.

13. The dry cleaning preparation of claim 10 wherein, before or during production of said porous granulate, the zeolite is adjusted with an acid to pH-value of from 6.5 to 9 (as measured on 1% suspension of the granulate in water).

14. The dry cleaning preparation of claim 10 wherein said surfactant is selected from the group consisting of adducts of from 1 to 30 mols of ethylene oxide with long-chain primary or secondary alcohols containing from 10 to 20 carbon atoms or with alkylphenols containing from 6 to 14 carbon atoms in the alkyl groups and mixtures thereof.

15. The dry cleaning preparation of claim 10 wherein said organic solvent has a boiling point above 80° C. and is selected from the group consisting of benzines, alcohols, ethers, esters and mixtures thereof.

16. The dry cleaning preparation of claim 10 wherein said granulating aid is selected from the group consisting of water-soluble alkali metal silicates, water-soluble polymeric carboxylic acids and salts thereof, water-soluble cellulose derivatives and mixtures thereof.

17. A process for the production of a dry cleaning preparation in powder form for cleaning carpets and textiles comprising:

(1) mixing (a) from 40 to 90% by weight of zeolite, (b) from 1 to 20% by weight of a granulating aid for said zeolite, and (c) up to 10% by weight of a solid, water-soluble acid, to form a porous zeolite granulate which withstands the mechanical stressing normally encountered in dry cleaning and contains less than 2% by weight of particles 0.05 mm in size and smaller and less than 5% by weight of particles larger than 2 mm as determined by sieve analysis and have a mechanical stability when subjected to a vibrating ball mill filled with about 5 porcelain balls 28 mm in diameter for 1 minute at 1400 rpm and then sieved, such that the proportion of particles up to 0.2 mm in size increases to no more than 15% by weight, based on the total weight of the granulate; and (2) combining said granulate with (d) from 0.5 to 15% by weight of a surfactant, and (e) from 5 to 30% by weight of an organic solvent.

18. The process of claim 17 wherein said dry cleaning preparation in powder form comprises;

from 55 to 75% by weight of zeolite Na-A, from 1 to 5% by weight of an adduct of from 4 to 15 mols of ethylene oxide onto $C_{12}$–$C_{18}$ fatty alcohols, from 8 to 25% by weight of an organic solvent selected from the group consisting of dipropylene glycol monomethylether, benzine, isopropanol and mixtures thereof, from 5 to 20% by weight of a granulating aid in the form of a combination of water-soluble sodium silicate and polyacrylic acid or polymethacrylic acid, and from 0 to 5% by weight of other usual constituents for dry cleaning preparations in powder form.

* * * * *